US008759756B2

(12) United States Patent
Iwasaki

(10) Patent No.: US 8,759,756 B2
(45) Date of Patent: Jun. 24, 2014

(54) TIME-OF-FLIGHT MASS SPECTROMETER

(71) Applicant: Canon Kabushiki Kaisha, Tokyo (JP)

(72) Inventor: Kota Iwasaki, Atsugi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/861,243

(22) Filed: Apr. 11, 2013

(65) Prior Publication Data

US 2013/0270432 A1 Oct. 17, 2013

(30) Foreign Application Priority Data

Apr. 16, 2012 (JP) ..... 2012-093145

(51) Int. Cl.
*H01J 49/40* (2006.01)

(52) U.S. Cl.
CPC ..... *H01J 49/403* (2013.01)
USPC ..... 250/287

(58) Field of Classification Search
CPC ..... H01J 49/403
USPC ..... 250/287
See application file for complete search history.

(56) References Cited

U.S. PATENT DOCUMENTS 5,969,348 A * 10/1999 Franzen ..... 250/282
2002/0020812 A1 * 2/2002 Vestal et al. ..... 250/287

FOREIGN PATENT DOCUMENTS

JP 2008-282726 A 11/2008

* cited by examiner

*Primary Examiner* — Jack Berman
*Assistant Examiner* — Eliza Osenbaugh-Stewar
(74) *Attorney, Agent, or Firm* — Canon U.S.A., Inc. IP Division

(57) ABSTRACT

A time-of-flight mass spectrometer includes a holder that holds a sample, an irradiation unit that irradiates a surface of the sample with primary ions, an extractor electrode that opposes the sample, and an ion detector that detects a secondary ion emitted from the surface of the sample in accordance with a time of flight of the secondary ion. The surface of the sample has first and second positions, and the irradiation unit and the holder are disposed so that the primary ions are obliquely incident upon the surface of the sample. A primary ion reaches the first position before another primary ion reaches the second position. A potential gradient generator generates a potential gradient so that a potential difference between the second position and the extractor electrode is larger than a potential difference between the first position and the extractor electrode.

12 Claims, 6 Drawing Sheets

TIME-OF-FLIGHT MASS SPECTROMETER

BACKGROUND OF THE INVENTION

1. Field of the Invention

The present invention relates to a time-of-flight mass spectrometer with which mass spectrometry is performed by ionizing at least part of a sample to be measured and by measuring the time of flight of ions.

2. Description of the Related Art

Recently, imaging mass spectrometry has been attracting attention as a technology for measuring the distribution of substances on the surface of a sample in such fields as pathology research and development of new pharmaceuticals. In an imaging mass spectrometry technology, mass spectrometry is performed on the surface of a sample and a two-dimensional distribution of detection intensity corresponding to the mass-to-charge ratios of the substances is obtained, and thereby information regarding the distribution of the substances in the sample surface is obtained. With imaging mass spectrometry, biological molecules such as protein and drug molecules can be identified and, furthermore, the spatial distribution of these molecules can be measured with high spatial resolution.

In general, mass spectrometry is a method in which a spectrum that includes the mass-to-charge ratios and the detection intensities of an ionized sample is obtained by being irradiated with laser light, ions, electrons, or the like so as to separate the sample in terms of the mass-to-charge ratios.

Examples of measures used to generate ions from a sample include laser beams and charged particle beams such as ion beams. These beams are generally referred to as primary beams. When an ion beam is used as the primary beam (primary ion beam), generated ions are referred to as secondary ions. Examples of known methods in which a laser is used as the primary beam include a matrix-assisted laser desorption/ionization (MALDI) method, in which a sample mixed with a matrix and crystallized is ionized by being irradiated with a pulsed and tightly converged laser beam, and a secondary ion mass spectrometry (SIMS) method, in which a sample is ionized by being irradiated with a primary ion beam.

In many cases, a time-of-flight method is adopted as a method of separating and detecting an ionized sample in terms of the mass-to-charge ratios, which is suitable for detecting molecules having a large mass such as protein. In a time-of-flight mass spectrometer, ions are generated in pulses on the surface of the sample and the generated ions are accelerated by an electric field in a vacuum. Since the velocity at which an ion flies varies depending on the mass-to-charge ratio of the ion, by measuring the time taken for an ion to fly a certain distance from when the ion is emitted from the sample to when the ion reaches a detector, the mass-to-charge ratio of the ion can be measured.

There are two-type of techniques of the imaging mass spectrometry technology, that is, scanning-type and projection-type techniques.

In the scanning-type, a fine region (depending on a beam diameter of a primary beam) on the sample is sequentially subjected to mass spectrometry, and the distribution of substances is reconstructed from results of mass spectrometry and positional information of the fine region.

In the projection-type technique, a large region of a sample is irradiated with a primary beam having a comparatively large irradiation region on the sample so as to ionize the sample, and a position/time sensitive detector is used to detect a time at which the generated ions reach the detector and a position on a detection surface of the detector where the ions reach. With this structure, a spatial distribution of substances included in the sample can be measured by simultaneously measuring the masses of detected ions and the positions of the ions on the surface of the sample.

A typical example of mass spectrometers is disclosed in Japanese Patent Laid-Open No. 2008-282726. In this mass spectrometer, ion beams are used and a bias potential is uniformly applied to a substrate. When ions are used as a primary beam, compared to the case in which a sample is irradiated with laser light, there is no need of use of a matrix, and secondary ions is easily uniformly generated. Thus, resolution in imaging is improved.

In related-art scanning-type time-of-flight mass spectrometers and projection-type time-of-flight mass spectrometers, a primary ion beam is often obliquely incident upon the surface of a sample. This structure is adopted in order to avoid interference of a primary ion irradiating system with an ion detection system that detects ions emitted from the sample.

The sample is irradiated with a primary ion beam pulsed with respect to time. The reason for this is to measure the time-of-flight of the secondary ions by generating the secondary ions in pulses.

A primary ion beam often spreads in a direction perpendicular to the beam direction. For this reason, when the primary ion beam is obliquely incident upon the surface of the sample, as illustrated in FIG. 1B, the distance between an ion source (not shown) and a sample 2 varies in accordance with a position on the surface of the sample 2.

As a result, the time taken for the primary ions emitted from the ion source in pulses to reach the surface of the sample 2 varies with the position on the surface of the sample 2.

Particularly in a projection-type time-of-flight mass spectrometer, a primary ion beam, with which a large region is irradiated, is used. That is, spreading of the primary ion beam in a direction perpendicular to the beam traveling direction is non-negligible. Thus, the above-described time variation causes a problem.

Also in a scanning-type time-of-flight mass spectrometer, in which such spreading of the primary ion beam is so small that the spreading is negligible, the distance between the ion source and the sample 2 varies in accordance with the position on the surface of the sample 2 when the position irradiated with the primary ion beam is moved due to scanning.

In the case where the distribution of substances in the sample is measured, the time when primary ions reach the surface of the sample 2 varies in accordance with the position because the position irradiated with the primary ion beam on the surface changes due to the movement of the primary ion beam.

In positions where the primary ions reach earlier, the secondary ions are generated on the surface of the sample earlier. In positions where the primary ions reach later, the secondary ions are generated on the surface of the sample later. As a result, time variation among times when the secondary ions are generated occurs in accordance with the position on the surface of the sample (referred to as "generation time variation" hereafter).

The generation time variation is part of errors in measurement of the time of flight of secondary ions, and accordingly, errors are observed in measured masses of the secondary ions.

For example, when a secondary ion is generated at a position where a primary ion reaches earlier than other positions on the surface of the sample, the time of flight of the secondary ion appears to be short. Thus, a smaller mass-to-charge ratio (m/z) is measured for the secondary ion. In contrast, when a secondary ion is generated at a position where a primary ion reaches later on the surface of the sample, the time of flight of the secondary ion appears to be long. Thus, a larger mass-to-charge ratio (m/z) is measured for the secondary ion.

Thus, there is a problem in that errors are observed in mass measurement of the secondary ions in accordance with the position on the surface of the sample.

In the time-of-flight mass spectrometer disclosed in Japanese Patent Laid-Open No. 2008-282726, although a bias voltage is uniformly applied to a sample, it is difficult for this mass spectrometer to suppress errors observed relating to the generation time variation of the secondary ions on the surface of a sample.

That is, in related-art time-of-flight mass spectrometers in which the primary ion beam is obliquely incident upon the surface of the sample, it is difficult to prevent time at which the primary ions reach the surface of the sample from varying. As a result, errors are observed in measurement of the time of flight of the secondary ions and in measurement of masses. Accordingly, there is a problem in that an accurate analysis is difficult.

SUMMARY OF THE INVENTION

The present invention provides a time-of-flight mass spectrometer with which the error in measurement of the time of flight of the secondary ions is decreased, thereby allowing mass measurement of the secondary ions to be accurately performed.

A time-of-flight mass spectrometer according to the present invention includes a holder that holds a sample, a primary ion irradiation unit that irradiates a surface of the sample with primary ions, an extractor electrode that opposes the sample, a potential gradient generator that generates a potential gradient, and a detector that detects a secondary ion emitted from the surface of the sample in accordance with a time of flight of the secondary ion. In the time-of-flight mass spectrometer, the surface of the sample has first and second positions, and the primary ion irradiation unit and the holder are disposed so that the primary ions are obliquely incident upon the surface of the sample. A primary ion reaches the first position before another primary ion reaches the second position. In the time-of-flight mass spectrometer, the potential gradient generator generates the potential gradient so that a potential difference between the second position and the extractor electrode is larger than a potential difference between the first position and the extractor electrode.

In a method of time-of-flight mass spectrometry according the present invention, a surface of a sample is irradiated with primary ions, and a secondary ion emitted from the surface of the sample is detected in accordance with a time of flight thereof. In the method of time-of-flight mass spectrometry, the surface of the sample has first and second positions, and the primary ions are obliquely incident upon the surface of the sample. A primary ion reaches the first position before another primary ion reaches the second position. In the method of time-of-flight mass spectrometry, the secondary ion is detected in a state in which a potential gradient has been generated so that a potential difference between the second position and an extractor electrode is larger than a potential difference between the first position and the extractor electrode.

According to the present invention, variation in time at which the secondary ions reach the secondary ion detector can be reduced. This variation in time is caused by the generation time variation of the secondary ions occurring when the primary ions are obliquely incident upon the surface of the sample. As a result, the error observed when measuring the time of flight of the secondary ions is decreased, thereby allowing mass measurement of the secondary ions to be accurately performed.

Further features of the present invention will become apparent from the following description of exemplary embodiments with reference to the attached drawings.

DESCRIPTION OF THE EMBODIMENTS

Figure 1A:
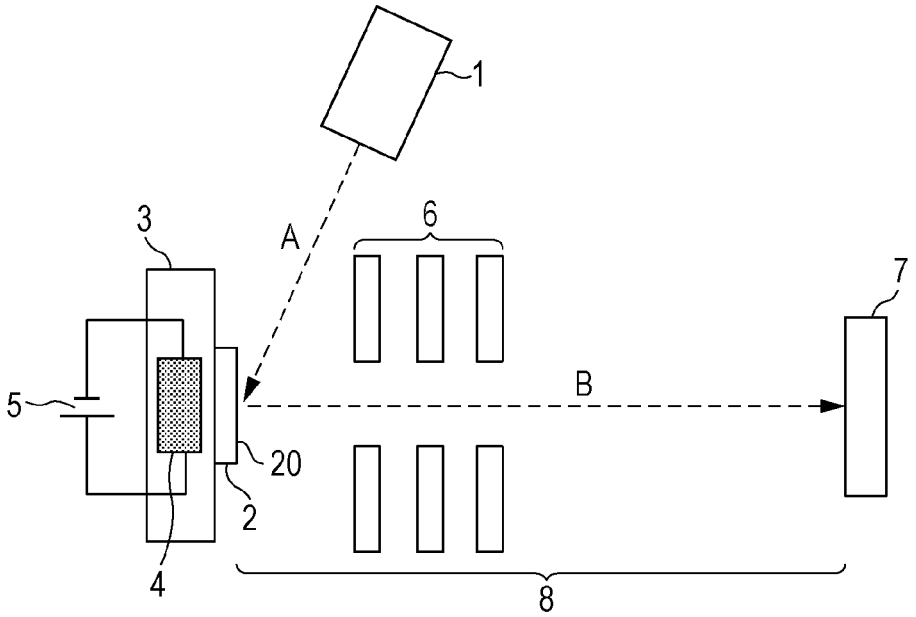
FIG. 1A illustrates a time-of-flight mass spectrometer according to the present invention.

FIG. 1A illustrates an embodiment of a time-of-flight mass spectrometer according to the present invention.

The time-of-flight mass spectrometer includes an ion source 1, a holding unit 3, a potential gradient generator 4, extractor electrodes 6, and a secondary ion detector 7. The ion source 1 serves as a primary ion irradiation unit that irradiates a sample 2 with primary ions as a primary ion beam. The holding unit 3 holds the sample 2. The potential gradient generator 4 is disposed in the holding unit 3. The extractor electrodes 6 oppose the sample 2. The secondary ion detector 7 serves as a detector that detects secondary ions in accordance with the time of flight. Although not illustrated, the time of flight mass spectrometer also includes a vacuum exhaust system and a signal processing system.

The extractor electrodes 6 are disposed so as to oppose a surface of the sample 2 and have the function of collecting secondary ions emitted from the sample 2. The extractor electrodes 6 are disposed between the sample 2 and the secondary ion detector 7 so that collected secondary ions can be directed to the secondary ion detector 7.

The primary ion source 1 can use an electron collision ion source, a surface ionization ion source, or a liquid metal ion source. It is desirable that high-speed pulse drive at a pulse width of about several ns or smaller be possible.

Although typical acceleration energy of a primary ion beam is from about several to several tens keV, the acceleration energy of the primary ion beam may be equal to or greater than several tens keV from a viewpoint of a converging property of the primary ion beam and improvement of efficiency in secondary ion generation.

When cluster ions are used as the primary ions, the acceleration energy per atom or molecule of the cluster ions is preferably equal to or smaller than 8.3 eV. For example, the acceleration energy of $(Ar_{1000})^+$ is preferably smaller than 8.3 keV. In such a case, so-called soft ionization, in which secondary ions can be generated under the conditions where dissociation of the sample 2 is decreased, can be performed, and accordingly, the mass of high molecules such as protein can be measured with good sensibility. The reason of this is that dissociation of the sample 2 is suppressed in the case where kinetic energy of each atom or molecule included in a cluster ion is equal to or smaller than the following chemical bond energy of the sample 2: C—C (3.6 eV), C—N (2.8 eV), C—H (4.3 eV), C—O (3.4 eV), or C═O (8.3 eV), for example.

Likewise, effects of suppressing dissociation of C—H bond, C—C bond, C—O bond, and C—N bond should be respectively produced when kinetic energy of an atom or a molecule of a cluster ion is 4.3 eV, 3.6 eV, 3.4 eV, and 2.8 eV.

The acceleration energy of a cluster ion is preferably equal to or greater than 0.01 eV, which is thermal energy of the sample 2.

Figure 1B:
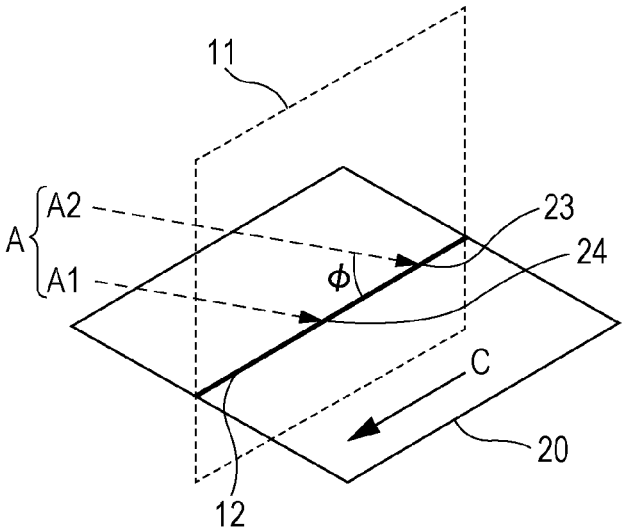
FIG. 1B illustrates directions and positions of primary ions incident upon a sample.

As illustrated in FIGS. 1A and 1B, the primary ions emitted in pulses from the primary ion source 1 are incident upon the sample 2 in an incident axis A direction at an angle Φ in a range from 0 degree (that is, parallel to the surface of the sample 2) to 90 degrees. When primary ions are obliquely incident upon a sample surface 20, collision between the primary ions in the incident axis A direction and the extractor electrodes 6 can be avoided.

An electric field that accelerates secondary ions B toward the extractor electrodes 6 may be generated by applying a potential Vex, which is appropriate with respect to the potential of the sample 2, to the extractor electrodes 6. Compared to a case in which this electric field is not present, this is advantageous in that efficiency in collecting secondary ions is improved.

The secondary ions emitted from the sample 2 are collected by the extractor electrodes 6, and after that, accelerated up to a predetermined energy due to a potential between the extractor electrodes 6 and the secondary ion detector 7 so as to be detected by the secondary ion detector 7.

The time taken for the secondary ions to pass through a secondary ion optical system 8 (flight time) can be measured as the difference between a time when the secondary ions are generated and a time when the secondary ions are detected by the secondary ion detector 7. Thus, the mass (m/z) of the secondary ions can be measured from the velocity of the secondary ions.

When a so-called projection-type, in which a position sensitive detector is used and the secondary ion optical system 8 including the extractor electrodes 6 causes a secondary ion image on the sample 2 to be formed on the secondary ion detector 7, is used, there is an advantage in that the distribution of substances in a region irradiated with the primary ions can be simultaneously measured.

When a so-called scanning-type technique, in which a mass analysis is performed on a fine region irradiated with the primary ion beam while the fine region is being scanned, is used, the distribution of substances of the sample 2 can be measured from positional information of the fine region and a mass analysis result.

According to the present invention, as illustrated in FIG. 1B, the primary ion irradiation unit obliquely irradiates the sample surface 20 with the primary ions. Thus, the time when the primary ions having been simultaneously emitted from the ion source 1 reach the sample surface 20 varies depending on positions (23 and 24) on the sample surface 20. For this reason, in comparison with a potential difference between the extractor electrodes 6 and a position at which the primary ions reach earlier on the sample surface 20, a potential difference is increased between the extractor electrodes 6 and a position at which the primary ions reach later on the sample surface 20. This cancels out the generation time variation of the secondary ions as will be described later.

Although the above-described cancellation is achieved by using a potential gradient generator 4 as described in FIG. 1A in the present embodiment according the present invention, the method of canceling the generation time variation is not limited to this structure as will be described in other embodiments. As illustrated in FIG. 1B, the potential gradient generator 4 can generate a potential gradient C so that the potential gradient C is substantially parallel to a line of intersection 12 along which the sample surface 20 intersects a plane 11, which includes the primary ion beam incident axis A and is perpendicular to the sample surface 20 (intersects the sample surface 20). In particular, the potential gradient C can be generated such that a direction in which the incident direction of the primary ions is perpendicularly projected toward the sample surface 20, that is, the direction of the line of intersection 12, matches the direction of the potential gradient C. The potential gradient C can be generally represented by a vector.

The sample surface 20 may have irregularities or be inclined. In such cases, a reference plane may be appropriately set in accordance with the undulation of irregularities. Specifically, for example, the sample surface 20 may be defined as a plane obtained by averaging differences in height of irregular shapes. When the entire sample surface 20 is a smoothly curved surface, the height of the sample surface 20 may be averaged so as to set a plane of the sample surface 20.

When it is assumed that the sample 2 is a thin piece having a predetermined thickness such as a microtome section, the sample surface 20 may be set with consideration of the thickness of a thin piece with reference to a holding surface of the holding unit 3 on which the sample 2 is positioned.

In the present invention, it is sufficient that the direction of the potential gradient C has a component parallel to the line of intersection 12. In other words, the potential gradient C that has only a component vertical to the line of intersection 12 is excluded. In particular, the direction of the potential gradient C can be substantially parallel to the line of intersection 12.

It is sufficient that the potential gradient generator 4 be able to generate a potential gradient near the sample surface 20. The potential gradient generator 4 can include a voltage applying unit such as a power unit and a resistance body connected to the voltage applying unit, or an electrode pair. Alternatively, the potential gradient generator 4 may use a resistance film formed on the surface of the holding unit 3.

Figure 4A:
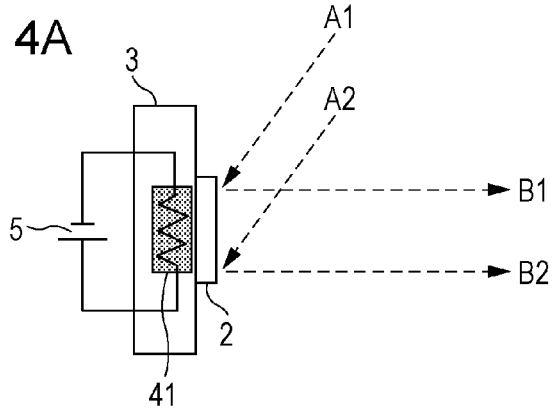
FIG. 4A illustrates a potential gradient generator using a resistor.
Figure 4B:
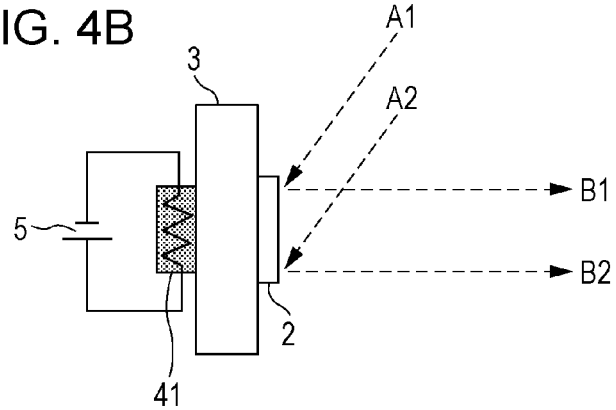
FIG. 4B illustrates a variation of the potential gradient generator using a resistor.
Figure 4C:
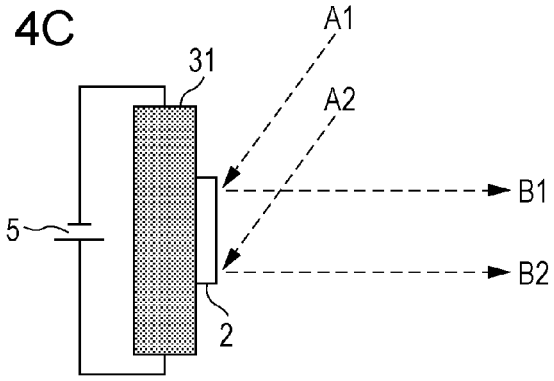
FIG. 4C illustrates a potential gradient generator that causes a current to flow through the sample holding unit.

The potential gradient generator 4 can have at least one of a resistance body provided separately from the holding unit 3 and a resistance body provided integrally with the holding unit 3, or electrodes through which an electrical current flows through the sample 2. The potential gradient generator 4 may utilize a resistor 41 (see FIGS. 4A and 4B) provided in the sample holding unit 3 or a voltage drop occurring when a current flows through the sample holding unit 3 (see FIG. 4C).

A structure in which part or the entirety of the sample holding unit 3 is formed of a resistance body is advantageous in that the sample holding unit 3 can serve as the potential gradient generator 4 by causing a current to flow through the sample holding unit 3.

Alternatively, electrodes may be provided in the sample holding unit 3 so as to generate a potential gradient (see FIGS.

Figure 4D:
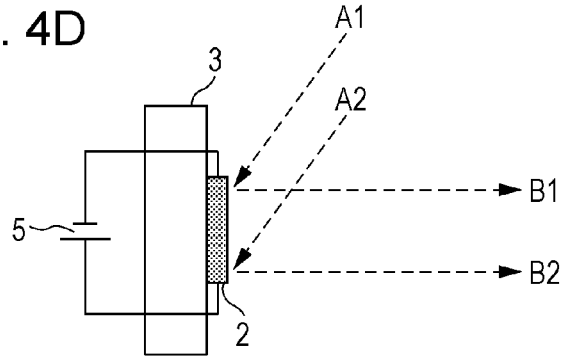
FIG. 4D illustrates a potential gradient generator that causes a current to flow through the sample.

5A, 5B, 6A and 6B), or a current may be caused to flow through the sample 2 (see FIG. 4D).

Referring to FIG. 1B, operation of the potential gradient generator according to the present invention is described.

Since the potential gradient C has a component parallel to the line of intersection 12, a potential Vf at a first point 24, where the primary ion reaches the sample surface 20 earlier, and a potential Vs at a second point 23, where the primary ion reaches the sample surface 20 later, are different from each other (hereafter, a potential Vh of the sample holding unit 3 is set as the reference).

An extraction voltage for the secondary ions emitted from the first point 24 is a potential difference Vex−Vf calculated by subtracting Vf from a voltage Vex of the extractor electrodes 6. Likewise, an extraction voltage with respect to the second point 23 is a potential difference Vex−Vs.

Hereafter, when the positive secondary ions emitted from the sample 2 are focused for simplicity of description, the secondary ions are extracted toward the extractor electrodes 6 in the case where both or one of Vex−Vf and Vex−Vs are a negative voltage.

When secondary ions having the same mass-to-charge ratio are accelerated by different extraction voltages, the flight velocities of the secondary ions differ from each other.

Here, when both of Vex−Vs and Vex−Vf are negative voltages and satisfy the relationships given by expressions (1) to (1)" below, the secondary ion emitted from the second point 23 is accelerated faster toward the extractor electrodes 6 compared to the secondary ion emitted from the first point 24.

$$\sqrt{\frac{-2e(Vex-Vs)}{m}} > \sqrt{\frac{-2e(Vex-Vf)}{m}}, \quad \text{expression (1)}$$

$$Vex - Vf < 0, \quad \text{expression (1')}$$

$$Vex - Vs < 0, \quad \text{expression (1'')}$$

$$v23 = \sqrt{\frac{-2e(Vex-Vs)}{m}}, \quad \text{expression (2)}$$

$$v24 = \sqrt{\frac{-2e(Vex-Vf)}{m}}. \quad \text{expression (3)}$$

In expression (2), v23 denotes a velocity at which the secondary ion emitted from the second point 23 passes through the extractor electrodes 6, and in expression (3), v24 denotes a velocity at which the secondary ion emitted from the first point 24 passes through the extractor electrodes 6. The elementary charge is denoted by e and the mass of the secondary ion is denoted by m.

When there is a difference between the velocities at which the secondary ions pass through the extractor electrodes 6, the time of flight t taken for the secondary ions to be detected by the secondary ion detector 7 varies.

Thus, when the relationships represented by expressions (1) to (1") are satisfied, the difference between time t23 and time t24 can be decreased. The time t23 is time from when the secondary ion is emitted from the second point 23 to when the secondary ion reaches the secondary ion detector 7, and the time t24 is the time from when the secondary ion is emitted from the first point 24 to when the secondary ion reaches the secondary ion detector 7. This is because variation in the time of flight of the secondary ions can cancel out the generation time variation of the secondary ions.

As a result, in comparison with a case in which the potential gradient C is not provided (the case disclosed in Japanese Patent Laid-Open No. 2008-282726), variation in time at which the secondary ions having the same mass-to-charge ratio reach the secondary ion detector 7 is decreased, and accordingly, mass spectrometry is performed more accurately.

Here, the difference between the Vf and Vs needs to satisfy the relationship represented by expression (4) with respect to Vex in a direction in which the secondary ions are extracted toward the extractor electrodes 6. This is necessary so as to prevent the secondary ions from being not sufficiently extracted toward the extractor electrodes 6.

$$|Vex| > |Vf - Vs| \quad \text{expression (4).}$$

When not only the potential difference but also an electric field are considered, the potential gradient C (the same dimension as the electric field) in a direction connecting the first point 24 and the second point 23 is given by expression (5) using distance Lfs, which denotes the distance between the first point 24 and the second point 23.

$$C = \frac{Vf - Vs}{Lfs}. \quad \text{expression (5)}$$

When the distance between the extractor electrodes 6 and the sample 2 is denoted by Lex, an extraction electric field Eex generated between the extractor electrodes 6 for the secondary ions and the sample 2 is approximately given by expression (6).

$$Eex = \frac{Vex - \left(\frac{Vf + Vs}{2}\right)}{Lex} \approx \frac{Vex}{Lex}. \quad \text{expression (6)}$$

Here, as given by expression (7), Vex, C, and the like may be set such that the extraction electric field Eex acts more significantly on the secondary ions than the potential gradient C does. In this case, there is an effect by which the secondary ions are efficiently extracted toward the extractor electrodes 6.

$$C < Eex \quad \text{expression (7).}$$

Furthermore, when the secondary ions are emitted from the sample 2, the secondary ions often have kinetic energy (initial energy) of about 0.01 to 100 eV. When a component parallel to the line of intersection 12 in the initial energy is denoted by KE, in the case where the potential difference between the potential Vf at the first point 24 and the potential Vs at the second point 23 satisfies expression (8), spread of energy of the secondary ions represented by the initial energy is smaller than the difference in energy between the secondary ions emitted from the first point 24 and the second point 23. As a result, the effect of the initial energy on the paths in which the secondary ions fly is decreased, and accordingly, the above-described effect, which cancels out generation time variation of the secondary ions, should be more significantly produced.

$$KE < e|Vf - Vs| \quad \text{expression (8).}$$

Embodiments according to the present invention will be described in detail below.

First Embodiment

A time-of-flight mass spectrometer according to a first embodiment is described with reference to FIGS. 1A to 4D.

When measurement is started, the primary ion beam is emitted from the primary ion source 1 in pulses and incident upon the sample 2. In the present embodiment, the pulse width is in such a short length that the pulse width is negligible.

Figure 2A:
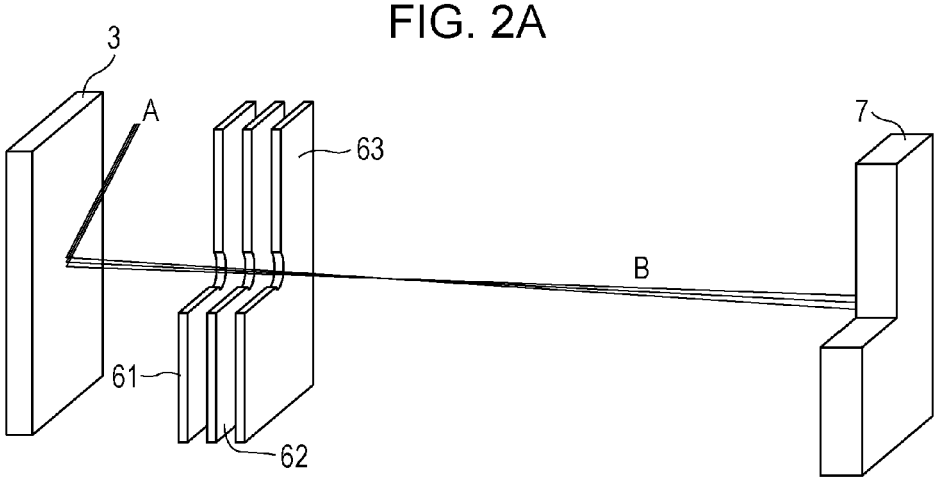
FIG. 2A is a sketch of a time-of-flight mass spectrometer according to a first embodiment.

FIG. 2A is a perspective view illustrating paths of the primary ions illustrated in accordance with ion optical simulation. The primary ion is a singly charged ion of a bismuth trimer (Bi3)+ having an acceleration energy of 4 keV and incident upon the sample surface 20 at 25 degrees in a path parallel to the page of FIG. 2B.

In order to avoid a decrease in measurement sensitivity due to a decrease in sputtering yield, the incident angle of the primary ions is preferably 2 degrees or larger and more preferably 3 degrees or larger relative to the sample surface 20. When the incident angle is set to an angle from 10 to 30 degrees, there are advantages in that the sputtering yield is increased and the sensitivity should be increased. That is, when the incident angle of the primary ions is set to an angle from 2 to 30 degrees relative to the sample surface 20, and preferably set to from 10 to 30 degrees relative to the sample surface 20, a time-of-flight mass spectrometer, which is desirable in terms of an increase in detection sensitivity, can be provided.

Figure 2B:
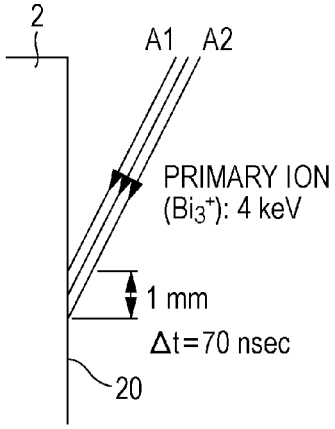
FIG. 2B illustrates conditions under which primary ions are incident upon a sample in the first embodiment.

As illustrated in FIG. 2B, the size by which the primary ion beam spreads on the sample surface 20 is 1 mm, and variation in time at which the primary ions reach the sample surface 20 is 70 ns at the maximum.

In the present embodiment, the resistor 41 as the potential gradient generator 4 is disposed on the surface of the sample holding unit 3. This surface of the sample holding unit 3 opposes an extractor electrode 61 (see FIG. 4A).

As an example, the resistor 41 has a resistance per unit length of 1 MΩ/m. When a 4 mA current flows through the resistor 41, a potential gradient as indicated by an arrow D in FIG. 3A is generated.

Figure 3A:
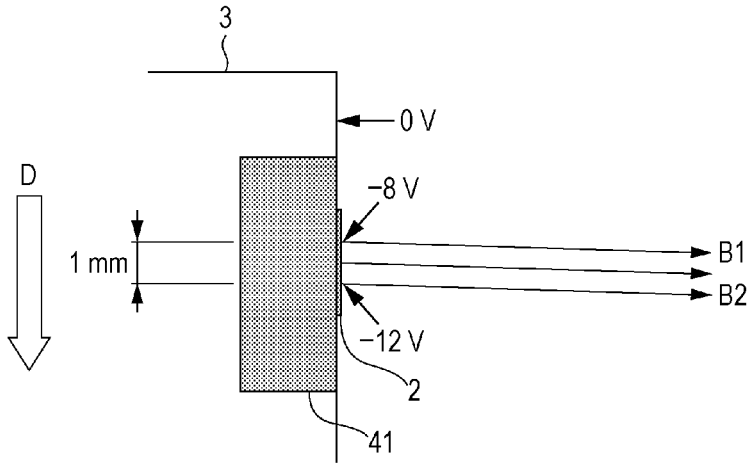
FIG. 3A illustrates conditions under which secondary ions are emitted from the sample when a potential gradient is generated.
Figure 3B:
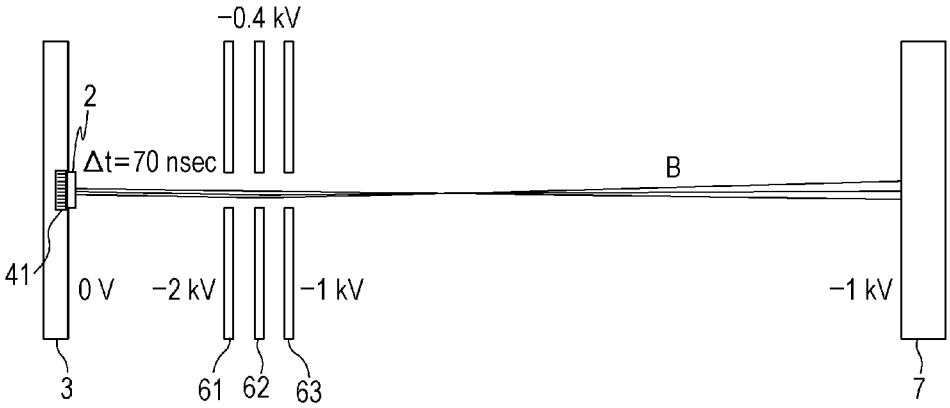
FIG. 3B illustrates simulated ion paths according to the first embodiment when a potential gradient is generated.

A direction in which the current flows is the arrow D direction, which is parallel to the page of FIG. 3A. Wires or the like connected to the resistor 41 are not illustrated in FIG. 3A.

The potential Vh of the holding unit 3 that holds the sample 2 is set to 0 V. A potential at one end of the resistor 41 is set to the same potential as that of the sample holding unit 3.

As a result, a potential gradient from −8 to −12 V exists at positions where the secondary ions are emitted (see FIG. 3A). That is, the potential Vf at the first point 24 in FIG. 1B is −8 V, and the potential Vs at the second point 23 in FIG. 1B is −12 V.

In the potential gradient generator 4 according to the present invention, the surface upon which the primary ions are incident and the current that flows through the resistor 41 are not necessarily set to be parallel to each other.

The secondary ions emitted from the sample surface 20 are accelerated by the extractor electrodes 6. The extractor electrodes 6 include three electrodes, each of which is an aperture type electrostatic lens having a coaxial circular opening. A voltage of −2 kV is applied to the first extractor electrode 61, a voltage of −0.4 kV is applied to a second extractor electrode 62, and a voltage of −1 kV is applied to a third extractor electrode 63.

The distance between the sample surface 20 and the first extractor electrode 61 is 50 mm. The distance between the first extractor electrode 61 and the second extractor electrode 62 is 7 mm, and the distance between the second extractor electrode 62 and the third extractor electrode 63 is also 7 mm.

In the present embodiment, the paths of the secondary ions are converged by the electric field generated among the three electrodes so as to be projected onto the secondary ion detector 7. However, the number of the extractor electrodes 6 is not necessarily three.

In the case where the above-described converging function is not provided, as long as the potential gradient C is provided, variation in time at which secondary ions having the same mass-to-charge ratio reach the secondary ion detector 7 can be decreased, and accordingly, accuracy of mass spectrometry can be improved.

The secondary ions are accelerated by the first extractor electrode 61, pass through the openings of the second extractor electrode 62 and the third extractor electrode 63, and are detected by the secondary ion detector 7 separated by 300 mm. A −1 kV potential is applied to the secondary ion detector 7.

A time when the secondary ion detector 7 detects a secondary ion and the signal intensity of the secondary ion are transmitted to the signal processing system. The secondary ion detector 7 may use a position/time sensitive detector. In this case, projection-type imaging mass spectrometry can be performed on the secondary ions.

The time of flight t of the secondary ion can be measured by measuring a time when the secondary ion reaches the secondary ion detector 7 with reference to a time when the primary ion is incident upon the sample 2.

In the present embodiment, the potential of the third extractor electrode 63 is set to the same value as a potential Vtof of the secondary ion detector 7. Thus, mass spectrometry can be performed on the secondary ions by using approximate expressions (9) and (10) from the time of flight t and the flying distance L of the secondary ion.

$$\frac{m}{z}2e(Vtof - Vs)\left(\frac{t}{L}\right)^2, \qquad \text{expression (9)}$$

$$\frac{m}{z} = 2e(Vtof - Vf)\left(\frac{t}{L}\right)^2. \qquad \text{expression (10)}$$

Figure 2C:
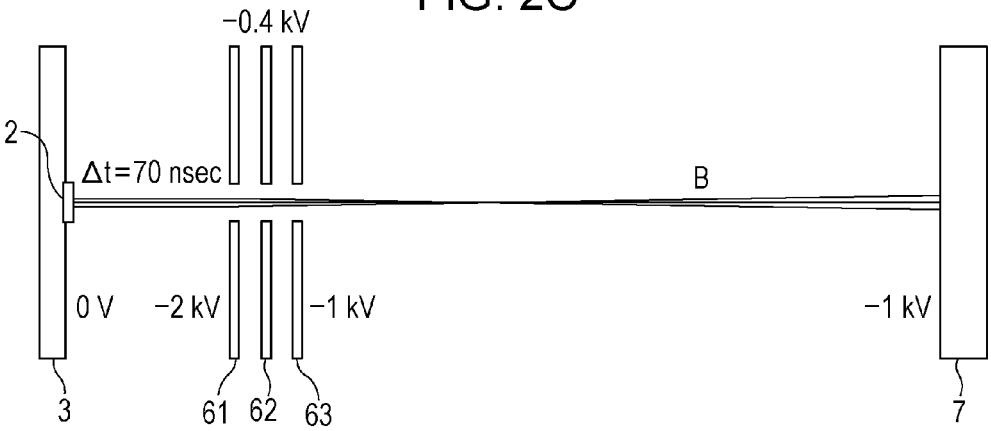
FIG. 2C illustrates simulated ion paths according to the first embodiment when no potential gradient is generated.

FIG. 2C illustrates a result of ion path simulation in the case where no current is caused to flow through the resistor 41, that is, the potential gradient generator 4 does not function. This simulation is performed in order to be compared with the effect produced by the present invention. Specifically, variation in time when the primary ions reach the sample surface 20 is assumed to be 70 ns, and an error Δm in mass measurement derived from the variation in time is calculated.

When the mass-to-charge ratio of the secondary ion is assumed to be 1000 m/z, the time of flight of the secondary ion is calculated from the ion path simulation as follows: the secondary ion B1 emitted from the first point 24; 21.33 μs, the secondary ion B2 emitted from the second point 23; 21.40 μs. The mass measurement error Δm is 7 m/z from expressions (5) and (6), which is a large value.

In contrast, when a 4 mA current is caused to flow through the resistor 41 as described above so as to generate the potential gradient (see FIG. 3A), and the same calculation as described above is performed (see FIG. 3B), the time of flight of the secondary ion is 21.39 to 21.40 μs. The resistor 41 is not illustrated in FIG. 3A.

The range of variation in the time of flight of the secondary ion is 10 ns or smaller and the mass measurement error Δm is 1 m/z or smaller. Thus, the error is decreased to equal to or smaller than one seventh of the value observed in the case where no current is caused to flow through the resistor 41.

In the present embodiment, the fact that the path length of the secondary ion that is emitted from the second point 23 and reaches the secondary ion detector 7 is smaller than that of the secondary ion that is emitted from the first point 24 and reaches the secondary ion detector 7 also contributes to a decrease in variation in time when the secondary ion reaches.

Here, Vex is −2.0 kV, Vf is −8 V, and Vs is −12 V. Thus, the relationship represented by expression (4) is satisfied.

Furthermore, since Lex is 50 mm and Lsf is 1 mm, the potential gradient C is −4 V/mm and the extraction electric field Eex is −40 V/mm. Thus, the relationship represented by expression (7) is satisfied.

Furthermore, the relationship represented by expression (8) is satisfied when the secondary ion is emitted from the sample surface 20 at a kinetic energy KE of about 1 eV in a direction parallel to the sample surface 20. Likewise, expression (8) is still satisfied even when the angle at which the secondary ion is emitted relative to the sample surface 20 becomes close to a right angle.

In the present embodiment, it is sufficient that the potential difference between Vf and Vs be about −1 V and the potential gradient C be equal to or greater than 1 V/mm.

Likewise, it is also sufficient that the potential gradient C be equal to or greater than 0.01 V/mm when the kinetic energy KE of the secondary ion is 0.01 eV, or the potential gradient C be equal to or greater than 0.1 V/mm when KE is 0.1 eV.

In the case where the kinetic energy of the secondary ion is high, adjustment may be performed so that Vf, Vs, and Vex satisfy expressions (4) to (8). For example, when KE is 10 eV, it is sufficient that the current that flows through the resistor 41 be adjusted so that Vex is increased to −20 kV, Vf becomes −80 V, and Vs becomes −120 V. In this case, the potential gradient C is 40 V/mm and Eex is 400 V/mm, and accordingly, the relationships represented by expressions (8) and (9) are satisfied.

Second Embodiment

A time-of-flight mass spectrometer according to a second embodiment is structured similarly to that of the first embodiment except for the potential gradient generator 4.

A potential gradient generator of the present embodiment is a holding unit including a resistance body that generates a potential gradient along the surface of the sample when a current flows through the resistance body. That is, by causing a current to flow through a holding unit 31 formed of a resistance body instead of the resistor 41, a potential gradient is generated (see FIG. 4C). The current flows in the same direction as that indicated by the arrow D in FIG. 3A.

When the resistance per unit length of the holding unit 31, which holds the sample, is set to the same value as the resistor 41 of the first embodiment, that is, 1 MΩ/m, a potential gradient similar to that in the first embodiment is generated for the sample 2 when a 4 mA current flows through the holding unit 31. As a result, as is the case with the first embodiment, effects of the present invention produced by decreasing the range of variation in the time of flight of the secondary ion can be achieved. In the present embodiment, the size of the holding unit 31 that generates the potential gradient can be increased with respect to the sample 2, an effect by which uniformity of the potential gradient is improved can be produced.

Third Embodiment

A time-of-flight mass spectrometer according to a third embodiment is structured similarly to that of the first embodiment except for the potential gradient generator 4. In the present embodiment, a potential gradient generator causes a current to flow through a sample. That is, by causing a current to flow through the sample 2 itself through a potential gradient generating electrode 42, a potential gradient is generated in the sample 2 as illustrated in FIG. 4D.

The direction of the current that flows through the sample 2 is the same as the direction indicated by the arrow D in FIG. 3A. The relationship between the current value and the resistance per unit length is similar to that in the case where the resistor 41 is used.

Also as is the case with the first embodiment, effects of the present invention produced by decreasing the range of variation in the time of flight of the secondary ion can be achieved. In the present embodiment, there is an advantage in that, even when the resistance of the sample 2 itself is not larger than that of the resistor 41 or the holding unit 31, a potential gradient can easily be generated.

Fourth Embodiment

A time-of-flight mass spectrometer according to a fourth embodiment is structured similarly to that of the first embodiment except for the potential gradient generator 4. In the present embodiment, the potential gradient generator is a pair of electrodes that are in contact with the holding unit and oppose each other so that the sample is interposed between the pair of electrodes.

Figure 5A:
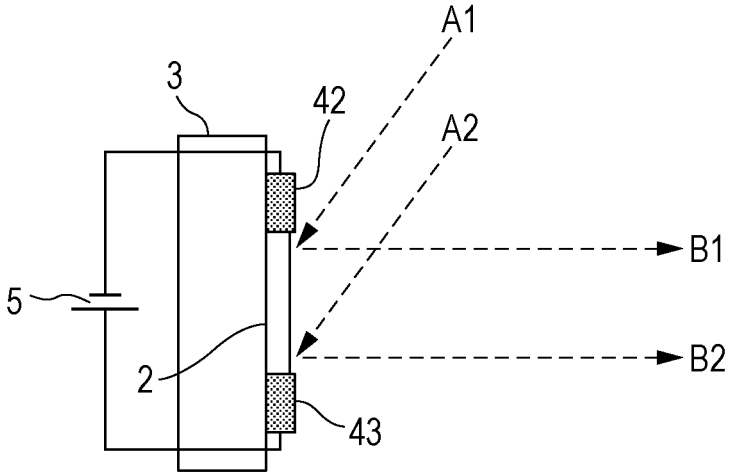
FIGS. 5A and 5B illustrate a structure according to a fourth embodiment of the present invention.

As illustrated in FIG. 5A, a first potential gradient generating electrode 42 and a second potential gradient generating electrode 43 are provided as the potential gradient generator on a surface of the sample holding unit 3. This surface of the sample holding unit 3 is irradiated with the primary ions. The first potential gradient generating electrode 42 and the second potential gradient generating electrode 43 oppose each other so that the sample 2 is interposed therebetween. A potential gradient can be generated between the opposing first potential gradient generating electrode 42 and the second potential gradient generating electrode 43 by applying an appropriate potential to the opposing first and second potential gradient generating electrodes 42 and 43.

In the present embodiment, a voltage of 0 V is applied to the first potential gradient generating electrode 42 and a voltage of −20 V is applied to the second potential gradient generating electrode 43. The distance between the first and second potential gradient generating electrodes 42 and 43 is 5 mm. A potential gradient similar to that illustrated in FIG. 3A can be generated for the sample 2.

As a result, also as is the case with the first embodiment, effects of the present invention produced by decreasing variation in the arrival time of flight of the secondary ion can be achieved.

The present embodiment is useful in the case where the sample 2 has a high resistance, and accordingly, it is impossible to cause a current sufficient to generate a potential gradient to flow through the sample 2, in particular, in the case where the third embodiment is not applicable. Furthermore, since there is no change in resistance due to resistance heating caused by a current, stability of the potential gradient is improved.

Figure 5B:
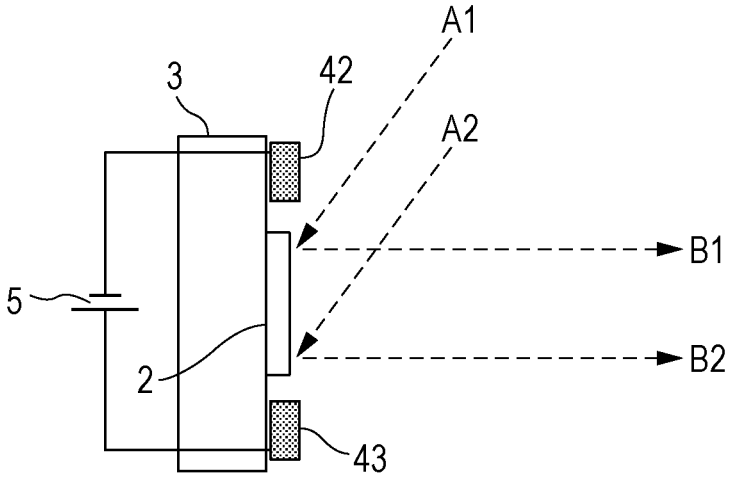

As illustrated in FIG. 5B, the potential gradient generator may use a pair of the first and second potential gradient generating electrodes 42 and 43 that are disposed between the holding unit 3 and the extractor electrodes 6 and oppose each other so that the sample 2 is interposed between the pair of first and second potential gradient generating electrodes 42 and 43. At least one of the first and second potential gradient generating electrodes 42 and 43 is not necessarily in contact with the holding unit 3. That is, at least one of the first potential gradient generating electrode 42 and the second potential gradient generating electrode 43 may be separated from the sample holding unit 3.

Fifth Embodiment

A time-of-flight mass spectrometer according to a fifth embodiment is structured similarly to that of the first embodiment except for the potential gradient generator 4.

Figure 6A:
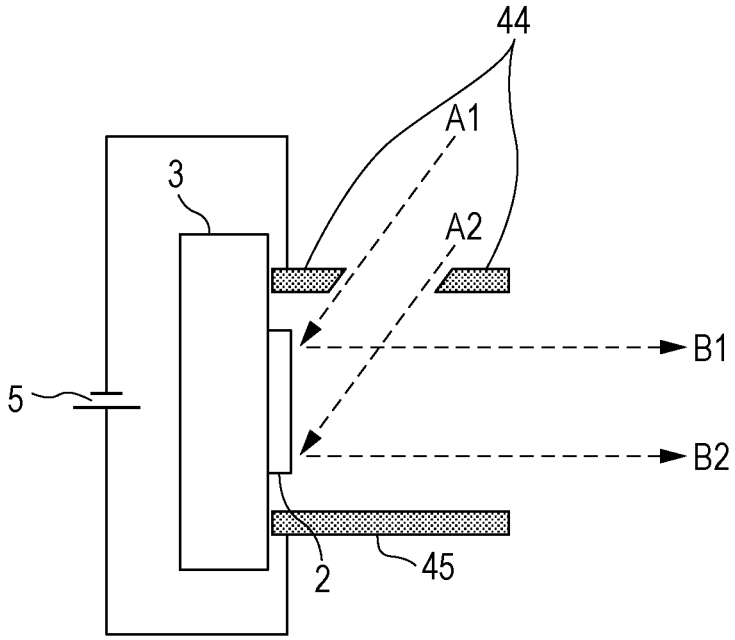
FIG. 6A illustrates a potential gradient generator according to a fifth embodiment.

As illustrated in FIG. 6A, similarly to the fourth embodiment, the potential gradient generator of the fifth embodiment is a pair of electrodes that are disposed on the holding unit and oppose each other so that the sample is interposed between the pair of electrodes. In the potential gradient generator according to the present embodiment, a potential gradient generating electrode with an opening 44 and a third potential gradient generating electrode 45 are provided on a surface of the sample holding unit 3, the surface being a surface to be irradiated with the primary ions.

Figure 6B:
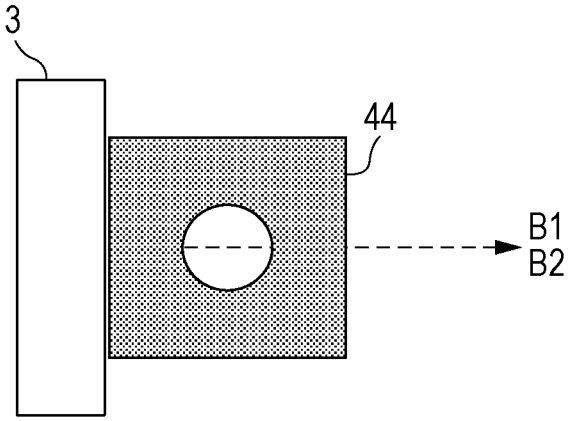
FIG. 6B illustrates the potential gradient generator seen from a direction of an opening.

The primary ions pass through the opening of the potential gradient generating electrode with an opening 44 (see FIG. 6B) and are incident upon the sample surface 20 in a direction parallel to the page of FIG. 6B.

As is the case with the fourth embodiment, a potential gradient can be generated between the potential gradient generating electrode with an opening 44 and the third potential gradient generating electrode 45 by applying an appropriate potential to these opposing electrodes 44 and 45. A voltage of 0 V is applied to the potential gradient generating electrode with an opening 44 and a voltage of −20 V is applied to the third potential gradient generating electrode 45. The distance between the potential gradient generating electrode with an opening 44 and the third potential gradient generating electrode 45 is 5 mm. A potential gradient substantially similar to that illustrated in FIG. 3A can be generated for the sample 2.

As a result, also as is the case with the first embodiment, effects of the present invention produced by decreasing variation in the arrival time of flight of the secondary ion can be achieved. Furthermore, in the present embodiment, by appropriately selecting the position of the opening, the angle at which the first ions are incident upon the sample surface can be flexibly set without being blocked by the potential gradient generating electrodes.

Since the sizes of the potential gradient generating electrodes can be increased relative to the sample 2 or the extractor electrodes, the potential gradient can be accurately generated.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-093145, filed Apr. 16, 2012, which is hereby incorporated by reference herein in its entirety.

What is claimed is:

1. A time-of-flight mass spectrometer comprising:

a holder that holds a sample;

a primary ion irradiation unit that irradiates a surface of the sample with primary ions;

an extractor electrode that opposes the sample;

a potential gradient generator that generates a potential gradient; and a detector that detects a secondary ion emitted from the surface of the sample in accordance with a time of flight of the secondary ion, wherein, the surface of the sample has first and second positions, and the primary ion irradiation unit and the holder are disposed so that the primary ions are obliquely incident upon the surface of the sample, wherein a primary ion reaches the first position before another primary ion reaches the second position, and wherein the potential gradient generator generates the potential gradient so that a potential difference between the second position and the extractor electrode is larger than a potential difference between the first position and the extractor electrode.

2. The time-of-flight mass spectrometer according to claim 1, wherein the potential gradient generator generates the potential gradient so that the potential gradient has a component parallel to a line of intersection along which the surface of the sample intersects a plane that includes a primary ion incident axis and is perpendicular to the surface of the sample.

3. The time-of-flight mass spectrometer according to claim 2, wherein the potential gradient generator generates the potential gradient so that the potential gradient is substantially parallel to the line of intersection.

4. The time-of-flight mass spectrometer according to claim 1, wherein the potential gradient generator includes at least one of a resistance body provided separately from the holder and a resistance body provided integrally with the holder.

5. The time-of-flight mass spectrometer according to claim 1, wherein the potential gradient generator includes an electrode that causes a current to flow through the sample.

6. The time-of-flight mass spectrometer according to claim 1, wherein the potential gradient generator includes a pair of electrodes that are disposed between the holder and the extractor electrode and that oppose each other so that the sample is interposed between the pair of electrodes and at least one of the electrodes is not in contact with the holder.

7. The time-of-flight mass spectrometer according to claim 1, wherein the potential gradient generator includes a pair of electrodes that are in contact with the holder and oppose each other so that the sample is interposed between the pair of electrodes.

8. The time-of-flight mass spectrometer according to claim 6, wherein at least one of the pair of electrodes has an opening that allows the primary ions to pass therethrough so as to be incident upon the surface of the sample.

9. The time-of-flight mass spectrometer according to claim 1, wherein the potential gradient generator generates the potential gradient so that intensity of the potential gradient is equal to or greater than 0.01 V/mm and equal to or smaller than intensity of a potential gradient generated between the sample and the extractor electrode.

10. The time-of-flight mass spectrometer according to claim 1, wherein the primary ion irradiation unit and the holder are disposed so that the primary ions are incident upon the surface of the sample at an angle in a range from 2 to 30 degrees relative to the surface of the sample.

11. The time-of-flight mass spectrometer according to claim 1, wherein the primary ions includes a cluster ion, and wherein energy of the primary ions incident upon the surface of the sample is equal to or greater than 0.01 eV and acceleration energy of an atom or a molecule included in the cluster ion is equal to or smaller than 8.3 eV.

12. A method of time-of-flight mass spectrometry, in the method, a surface of a sample being irradiated with primary ions, a secondary ion emitted from the surface of the sample being detected in accordance with a time of flight thereof, wherein, the surface of the sample has first and second positions, and the primary ions are obliquely incident upon the surface of the sample, wherein a primary ion reaches the first position before another primary ion reaches the second position, and wherein the secondary ion is detected in a state in which a potential gradient has been generated so that a potential difference between the second position and an extractor electrode is larger than a potential difference between the first position and the extractor electrode.

* * * * *